US011427416B2

(12) United States Patent
Seifert

(10) Patent No.: US 11,427,416 B2
(45) Date of Patent: Aug. 30, 2022

(54) DEVICE FOR SEPARATING THE LOWERMOST SHEET FROM A STACK

(71) Applicant: Kolbus GmbH & Co. KG, Rahden (DE)

(72) Inventor: Patrick Seifert, Niederau (DE)

(73) Assignee: Kolbus GmbH & Co. KG, Rahden (DE)

( * ) Notice: Subject to any disclaimer, the term of this patent is extended or adjusted under 35 U.S.C. 154(b) by 163 days.

(21) Appl. No.: 16/652,103

(22) PCT Filed: Sep. 17, 2018

(86) PCT No.: PCT/EP2018/025236

§ 371 (c)(1),
(2) Date: Mar. 30, 2020

(87) PCT Pub. No.: WO2019/063126

PCT Pub. Date: Apr. 4, 2019

(65) Prior Publication Data

US 2020/0270078 A1 Aug. 27, 2020

(30) Foreign Application Priority Data

Sep. 30, 2017 (DE) ..... 10 2017 009 208.7

(51) Int. Cl.
*B65H 3/24* (2006.01)
*B65H 1/06* (2006.01)
*B65H 1/30* (2006.01)

(52) U.S. Cl.
CPC ..... *B65H 1/06* (2013.01); *B65H 1/30* (2013.01); *B65H 3/24* (2013.01); *B65H 2511/13* (2013.01); *B65H 2511/22* (2013.01); *B65H 2701/176* (2013.01)

(58) Field of Classification Search
CPC ..... B65H 3/24; B65H 2301/42322; B65H 2701/176; B65H 1/06; B65H 1/30; B65H 2513/13
See application file for complete search history.

(56) References Cited

U.S. PATENT DOCUMENTS

| | | | | |
|---|---|---|---|---|
| 4,764,073 | A | 8/1988 | Garlichs et al. | |
| 5,074,432 | A * | 12/1991 | MacNamara | B65H 3/24 221/131 |
| 9,296,118 | B2 * | 3/2016 | Gerke | B26D 3/065 |
| 2003/0047090 | A1 | 3/2003 | Hill et al. | |
| 2011/0150621 | A1 | 6/2011 | Gysin et al. | |

FOREIGN PATENT DOCUMENTS

| | | | |
|---|---|---|---|
| JP | 10124620 A | * | 5/1998 |
| JP | 2004059181 A | * | 2/2004 |

OTHER PUBLICATIONS

International Search Report for International Patent Application No. PCT/EP2018/025236; dated Jan. 4, 2019; 4 pgs.

* cited by examiner

*Primary Examiner* — Luis A Gonzalez
(74) *Attorney, Agent, or Firm* — Alix, Yale & Ristas, LLP

(57) ABSTRACT

A device for separating a lowermost sheet from a stack, having a hopper for holding the stack and a pushing device arranged underneath the hopper and having a pushing element capable of being moved linearly back and forth, of which the pushing edge is movable relative to the bearing plane of the stack in the hopper, wherein the projection for positive conveying of this pushing edge changes with respect to the bearing plane.

13 Claims, 2 Drawing Sheets

DEVICE FOR SEPARATING THE LOWERMOST SHEET FROM A STACK

BACKGROUND

This invention relates to a device for separating a lowermost sheet from a stack according to the preamble of Claim 1.

Devices for separating stacked sheets of pasteboard or similar material are known. These devices Have a pushing device underneath a hopper, which is open at the top, for separating the lowermost sheet in each case. Such an arrangement allows the hopper to be refilled with sheets at any time without having to interrupt the separation process.

The hopper comprises bearing elements on which the stack rests. Lateral boundaries form a channel, which holds and laterally supports the stack in its position. In order to permit ready access, in particular for manually loading the hopper channel, the boundaries forming the channel are significantly smaller than the format of the sheets to be separated. The channel is thus interrupted multiple times in the circumferential direction, which makes intrusions possible. A sensor system is often mounted in the hopper for monitoring the current height of the stack. This enables an automatic prompting for refilling sheets before the hopper runs empty, thus simplifying the continuous supplying of subsequent devices with separated sheets.

The pushing device comprises a slide. In its linear forward movement, this slide catches the lowermost sheet by its back edge, slides it out from under the rest of the stack and transfers it to a removal device. Meanwhile, the rest of the stack is held in its position and stabilized by the hopper channel. After the separated sheet has been transferred to the removal device, the slide moves into its starting position so that it can catch the next sheet by its back edge.

To this end, the slide projects above the bearing elements of the hopper. The smaller this projection, the greater is the risk that the slide will run under the stack rather than catch the back edge of the lowermost sheet. Conversely, the projection must not exceed the material thickness of the sheet to be separated, in order to avoid unintentionally catching multiple sheets simultaneously. Thus, the slide is often configured as an interchangeable part in order to adapt the superelevation to the sheet thickness by changing the slide. This process is complicated and requires a machine shutdown or at least a production interruption, as well as exhaustive safety measures for personal protection.

SUMMARY OF THE INVENTION

The problem addressed by this invention is therefore that of creating a device which is improved over the prior art and which overcomes at least one of the cited disadvantages of the prior art.

The invention solves the problem by a device having the features of claim 1. Advantageous further developments of the invention are characterized by the features cited in the subordinate claims.

A hopper is provided for holding a stack of sheets to be separated. This hopper comprises bearing elements, which form a table. The stack rests on the bearing plane defined by this table. Provision can be made of side walls or side supports in the hopper for stabilizing the stack. However, these are not mandatory. In each case the lowermost sheet of the stack is pushed out in a push-out direction within the bearing plane relative to the rest of the stack.

In order to hold the rest of the stack in its position during the separation process, provision is made of a retaining device having one or multiple retaining elements. These retaining elements delimit the hopper in the push-out direction. The retaining elements are spaced at a distance from the bearing plane such that with the bearing table, they form a gap as a passage opening for each of sheets to be separated. This distance can be adjusted to the thickness of the sheets. For a trouble-free operation, the gap is slightly larger than the sheet thickness but significantly smaller than double the sheet thickness.

A pushing device is arranged underneath the bearing plane, which catches each lowermost sheet for positive conveying and moves it in the push-out direction. Because the rest of the stack is retained by means of said retaining device, the lowermost sheet is thus separated. To this end, the pushing device comprises a slide which is linearly displaceable in pushing direction. This slide has a pushing edge formed by a pushing element, which projects above the bearing plane to a specified degree. The slide moves forward parallel to the pushing direction, beginning in a starting position in a working stroke until it reaches an end position, and then moves back into the starting position. In the starting position of the slide, its pushing edge has at least a slight distance to the sheet to be separated. In its forward movement, the pushing edge firmly seizes the back edge of the lowermost sheet. In the movement range of the pushing element or elements, the hopper table is recessed or discontinuous.

A slipping of the pushing edge under the sheet to be separated and the simultaneous pushing-out of multiple sheets lying directly on top of one another are prevented by adjusting the projection of the pushing edge with respect to the bearing plane to the sheet thickness. According to the invention, this adjustment is made by arranging the pushing element movably on the slide in such a way that the projection of the pushing edge with respect to the bearing plane is variable. The device is thus easily adaptable to different thicknesses of the sheets to be processed.

To this end, the pushing element is advantageously mounted rotatably in the slide. The rotation axis runs parallel to the pushing direction. The pushing element has a contour which, depending upon the rotary position of the pushing element, leads to a different superelevation of the pushing edge with respect to the bearing plane. A simple and compact construction of the slide is thus possible. Also, an almost play-free mounting and precision adjustability of the pushing element are easily achievable.

In a particularly simple further development, the pushing element has two or more pushing edges distributed about its rotation axis. These pushing edges situated on the periphery of the pushing element are each spaced apart from one another in a peripheral direction in such a way that, depending on the rotary position of the pushing element, a single one of the pushing edges projects above the bearing plane for positive conveying. The pushing edges each have different elevations with respect to the bearing plane. An easy-to-operate, incremental adjustability to the sheet thickness is thus made possible.

In order to prevent an inadvertent displacement of the pushing edge, the pushing element is fixed in its rotary position. To this end, an elastic pressure piece is provided in the slide, the spring-mounted ball of which engages in depressions assigned to the pushing edges in the pushing element. As an alternative, use can also be made of other known means of fixation such as clamping.

The pushing device preferably comprises a position-adjusting device, which is drive-connected to the pushing element. The pushing edge can thus be displaced without stopping the machine or interrupting production. A separable clutch in the drive connection is particularly advantageous. A first clutch half is mounted on the pushing element and a second clutch half is arranged stationarily as far as the pushing movement is concerned and is drive-connected to a rotary drive of the position-adjusting device.

Particularly in conjunction with the fixing of the pushing element as far as its rotary position is concerned, an easy way is created for arranging the position-adjusting drive in a positionally-fixed manner and thus not subject to the accelerations of the pushing movement. The displacement of the pushing edge occurs in a park or setup position of the slide, in which the clutch is automatically closed. A park or setup position is advantageously situated outside the working range of the slide. An opening and closing of the clutch during each separation process is thus avoided.

In a further development, the pushing device or at least the pushing element thereof is displaceable perpendicularly to the pushing direction. This permits reliable separation of sheets with a width that significantly exceeds the length of the pushing edge and with different positions of the center of gravity of the sheet relative to the device.

Particularly advantageous is the use of at least one further pushing device of the same type and with the same pushing direction, wherein the pushing edges of the devices perpendicular to this common pushing direction are spaced apart from one another. An inadvertent twisting of the sheet during the separation is thus avoidable.

Each of these pushing devices preferably has a separate drive with a permanent drive connection to the corresponding slide. In this manner, the pushing devices can be switched on or off individually as a function of product type. To this end, use is advantageously made of respective controllable drives, which communicate with the control of the device via a data transmission line.

In one design, each controllable drive is formed by a linear servomotor. The stator has permanent magnets, whereas the rotor is mounted on the slide and comprises controllable electromagnets. The use of linear servomotors enables greater accelerations of the slide and thus improved separation performance. The use of a linear servomotor also enables the position of the slide along the pushing direction to be determined easily. Furthermore, different movement profiles can be defined for the slide owing to the servo drive. For example, these movement profiles can be adapted to the respective sheet lengths or they can comprise movement to a park or setup position outside the movement range of the slide required for the pushing.

The device advantageously has a sensor system, which detects, in a push-out direction downstream of the retaining device, the angular position of the conveyed sheet with respect to the push-out direction. For contactless detection, this sensor system can have a camera with corresponding image processing or light barriers, and it is connected to the control of the device via a data transmission line. A controlling of the angular position during the separation is possible in conjunction with controllable individual drives of pushing devices used in parallel.

Obviously, such a separation device can be one of multiple components of a sheet-processing installation. It is particularly suited for the separation of auxiliary stacks between the cutters of a high-performance pasteboard cutting installation.

BRIEF DESCRIPTION OF THE DRAWING

In the following, the invention will be described using an exemplary embodiment and with reference to the figures, to which reference shall be made regarding all details not mentioned any further in the description. Shown are.

DETAILED DESCRIPTION

Figure 1:
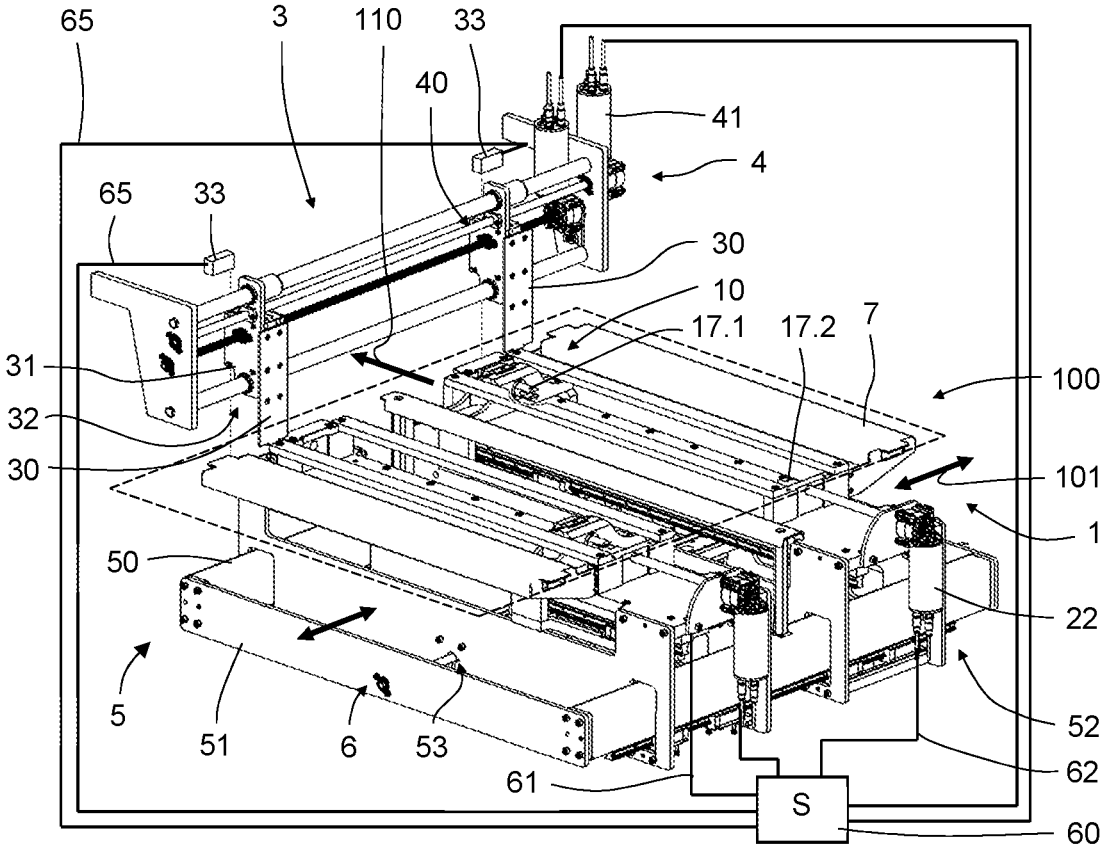
FIG. 1 a device for separating a lowermost sheet, in a perspective view.
Figure 2:
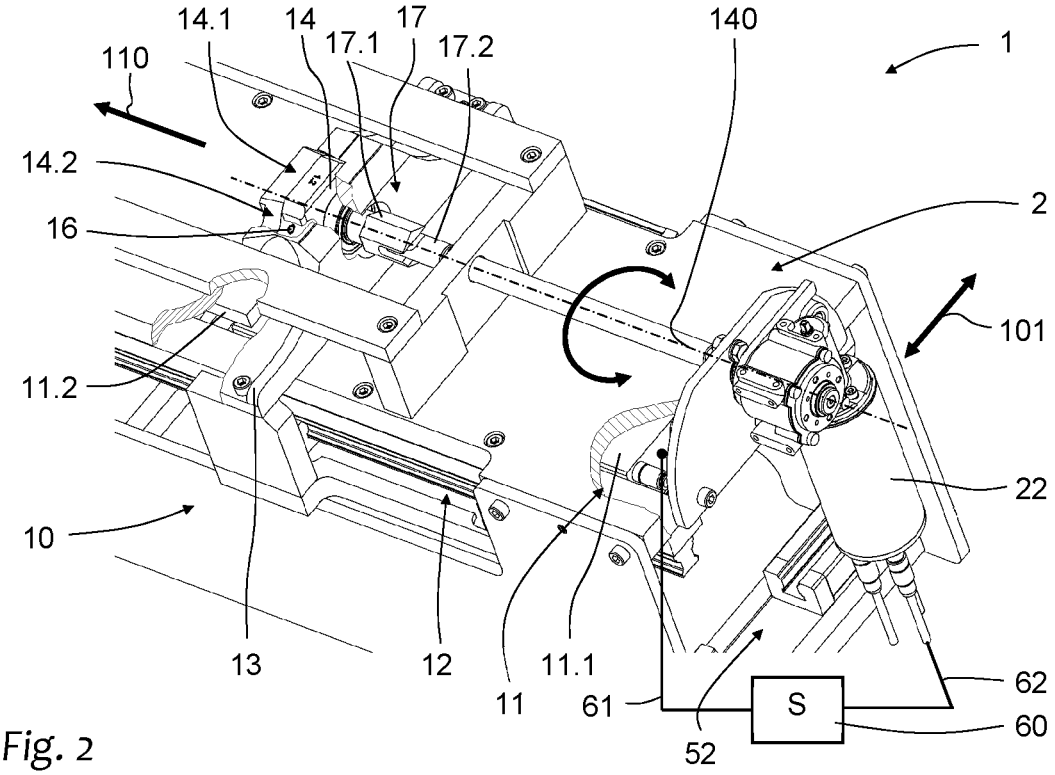
FIG. 2 a section of a separation device, in a perspective view.

As shown in FIG. 1, the device for separating a lowermost sheet from a stack comprises two similar pushing devices 1, which jointly separate one sheet in each case. The following explanations pertaining to one pushing device 1 apply equally to both pushing devices 1.

The hopper for holding a sheet stack is located above the pushing devices 1. The not illustrated sheet stack rests on the table 7 formed from multiple parts. The horizontal bearing surface of this table 7 defines the bearing plane 100. The parts of the table 7 are each at a distance from one another perpendicularly to the pushing direction 110. These spaces provide the necessary clearance for the pushing device 1. The hopper can be enhanced by adding a not illustrated stack monitor.

A retaining device 3, which delimits the hopper in the pushing direction 110, is provided above the bearing plane 100. This device comprises two retaining elements 30, which are held in a laterally displaceable manner by means of a linear guide 32 running perpendicularly to the pushing direction 110. Both retaining elements 30 are each mounted on the common guide rail by a holder 31. The holders 31 are each connected to a separate position-adjusting device. This position-adjusting device comprises a spindle drive 40 actuated by a controllable actuator 41.

The retaining elements 30 are mounted at a distance from the bearing plane 100 such that a passage opening is formed between the retaining elements 30 and the bearing plane 100 for the sheets to be separated. This distance is adjustable to the thickness of the sheet to be separated by means of a not illustrated position-adjusting device of known type.

A frame 5 made of one pair of cross members 50 and one pair of longitudinal members 51 holds the pushing devices 1. The latter are mounted in a width direction 101 perpendicular to the pushing direction 110 via linear guides 52. Respective controllable position-adjusting devices 6 with spindle drives 53 enable automatic format adjustment in a width direction 101 perpendicular to the pushing direction 110.

The pushing device 1 has a slide 10, which is arranged movably back and forth in a pushing direction 110 by means of a linear guide 12. The slide 10 is driven controllably along this linear guide 12 by a linear servomotor 11. The rotor 11.1 of the linear servomotor 11 is mounted on the slide 10 itself and connected to a control 60 of the device by a data transmission line 61. The stator is made of permanent magnets 11.2. The use of a linear servomotor 11 enables the position of the slide 10 along the pushing direction 110 to be easily determined. Furthermore, different movement profiles can be defined for the slide 10 owing to the servo drive. These movement profiles can be adapted to the respective sheet lengths or include the movement to a park or setup position outside the movement range of the slide needed for the pushing, for example.

The slide 10 bears a bearing bracket 13, in which the pushing element is mounted rotatably about an axis 140. The rotation axis 140 runs parallel to the pushing direction 110. The pushing element 14, which projects into a space or cutout of the hopper table 7, bears four pushing edges 14.1, 14.2 distributed uniformly about the rotation axis 140 for catching the lowermost sheet of the stack by its the back edge. Depending upon the rotary position of the pushing element 14, one of these pushing edges 14.1 points upwards and thus creates the projection with respect to the bearing plane 100 needed for the pushing. The respective projections of the individual pushing edges 14.1, 14.2 differ from one another such that the pushing element 14 can be incrementally adjusted to different sheet thicknesses by switching its operative pushing edge 14.1, 14.2.

In order to fix the rotary position of the pushing element 14, an elastic pressure piece 16 is provided in the mounting bracket 13. With its spring-mounted ball, the pressure piece 16 engages in a depression of the pushing element 14 assigned to the corresponding pushing edge 14.1, 14.2. The pushing element 14 is thus secured against inadvertent turning and can also be switched as needed to another pushing edge 14.1, 14.2.

A position-adjusting device 2 is provided for this adjustment of the pushing element 14. This device comprises a controllable positioning drive 22. The positioning drive 22 is connected to the control 60 of the device via a data transmission line 62. The drive connection to the pushing element 14 includes a separable clutch 17 consisting of two clutch halves 17.1, 17.2.

A first clutch half 17.1 is rigidly and permanently connected to the pushing element 14 and is thus also subjected to the movement of the slide 10. A second clutch half 17.2 is rigidly and permanently connected to the positioning drive 22 of the position-adjusting device 2. As far as the pushing movement is concerned, the positioning drive 22 with the second clutch half 17.2 is mounted stationarily on the pushing device 1. The second clutch half 17.2 comprises a blade, which engages in the slot of the first clutch half 17.1, whereas the slide 10 is situated in its setup position along the pushing direction 110. By leaving this setup position, the clutch 17 is separated and the drive connection between the pushing element 14 and the positioning drive 22 is interrupted.

The lower of the two pushing devices 1 shown in FIG. 1 has its slide 10 in a park or setup position, in which the clutch 17 is closed. The upper pushing device 1 on the other hand has its slide 10 in an essentially forward end position, in which the clutch 17 is open and a distinct distance between the two clutch halves 17.1, 17.2 is discernible.

The device comprises two light barriers 33 arranged on the retaining device 3. These are connected to the control 60 of the device via data transmission lines 65. The light barriers 33 detect the leading and the trailing edge of the separated sheet in the pushing direction 110 downstream of the retaining elements 30. In the pushing direction 110 at the same height, they are spaced at a distance from one another in the width direction 101 in such a way that they serve to detect the angular position of the leading and the trailing edges of the sheets. This angle information makes it possible for the control 60 to correct a detected angle error immediately during the pushing-out by variable actuation of the linear servomotors 11.

Figure 3:
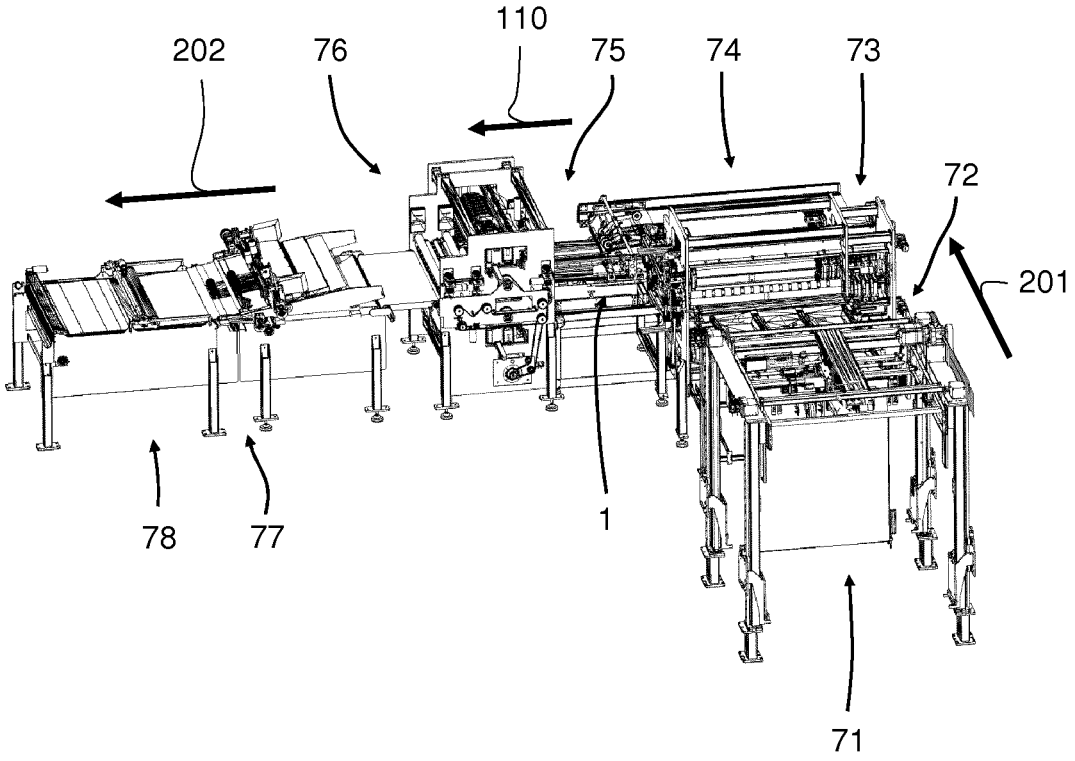
FIG. 3 an installation for cutting pasteboard sheets, in a perspective view.

FIG. 3 shows such a separation device as a component of a cutting installation for pasteboard sheets. This installation comprises a multiplicity of different devices, which apart from the described separation device 75 are sufficiently known and therefore shall not be described in any further detail here.

The installation comprises a first separation device 71 for separating an uppermost sheet from a stack. A first transport device 72 conveys the separated sheet in a first transport direction 201 to a subsequent first cutter 73. This first cutter 73 comprises multiple rotary cutters for separating the infed sheet into multiple sub-sheets parallel to one another. The sub-sheets are combined into auxiliary stacks in a subsequent first stacking device 74 in the first transport direction 201 and conveyed in a second transport direction 202 perpendicular to the first transport direction 201 into the hopper of the described separation device 75. The pushing direction 110 of the separation device 75 is identical to the second transport direction 202 of the installation. The re-separated (sub-)sheets are conveyed without changing direction through the downstream-disposed second cutter 76. The first cutter 73 and the second cutter 76 are similar and differ from each other essentially in the number and position of the respective longitudinal cuts. In the second transport direction 202, a second stacking device 77 connects to the second cutter 76, combines the cut sheets into stacks and feeds them to a delivery 78, from which these sheet stacks can be removed.

The invention claimed is:

1. A device for separating at least one lowermost sheet from a stack, comprising at least:

a hopper having at least one table (7) forming a bearing plane (100) for holding sheets of a stack, a pushing device (1) arranged underneath the hopper having at last one slide (10) that is movable back and forth in a pushing direction (110), having at least one pushing element (14) arranged on the slide (10) and which has at least one pushing edge (14.1, 14.2), wherein the least one pushing edge (14.1, 14.2) has a projection with respect to the bearing plane (100) for positive conveying, wherein the at least one pushing element (14) of the at least one pushing device (1) is arranged rotatably about a rotation axis (140) in a holder of the at least one slide (10), wherein the rotation axis (140) is arranged essentially parallel to the pushing direction (110), and a retaining device (3) having at least one retaining element (30), which delimits the hopper in the pushing direction (110) and is arranged at a distance from the bearing plane (100) in such a way that the at least one retaining element (30) forms a gap with the bearing plane (100) through which at least one lowermost sheet of the stack can be guided, wherein the gap and thus the passage height are adjustable, wherein the at least one pushing edge (14.1, 14.2) of the at least one pushing element (14) is movable relative to the bearing plane (100) of the hopper, wherein the projection for positive conveying of the at least one pushing edge (14.1, 14.2) changes with respect to the bearing plane (100).

2. The device of claim 1 wherein the pushing element (14) has at least two pushing edges (14.1, 14.2) distributed about the rotation axis (140) in such a way that, in accordance with the rotary position of the pushing element (14) about the rotation axis (140), exactly one of the pushing edges (14.1, 14.2) of said element has a projection for positive conveying with respect to the bearing plane (100).

3. The device of claim 1 wherein the at least one pushing element (14) or in a holder thereof, includes at least one clamping element or detent element (16), which fixes the pushing element (14) in a predetermined rotary position.

4. The device of claim 3 comprising a first position-adjusting device (2) having at least one controllable drive (22), which is at least temporarily drive-connected to the at least one pushing element (14) in such a way that the at least one controllable drive (22) determines the predetermined rotary position of the respectively associated pushing element (14).

5. The device of claim 4, wherein the first position-adjusting device (2) comprises at least one separable clutch (17), wherein a first clutch half (17.1) is arranged on the at least one pushing element (14) in such a way that the first clutch half (17.1) is rigidly connected to the pushing element (14) as far as the rotation axis (140) is concerned and that this first clutch half (17.1) performs the pushing movement jointly with the pushing element (14), and that a second clutch half (17.2) of the separable clutch (17) is arranged on the frame of the pushing device (1) rotatably about the rotation axis (140) of the pushing element (14) in such a way that the second clutch half (17.2) does not move in the pushing direction.

6. The device of claim 5, comprising an arrangement of the second clutch half (17.2), which is stationary as far as the pushing movement is concerned, in such a way that the closing of the clutch (17) is brought about by a movement of the slide (10), in a direction opposite the pushing movement, into the starting position of its pushing movement and/or into a position situated beyond the pushing movement of the slide (10).

7. The device of claim 1, wherein the at least one pushing device (1) is movable in a position-adjusting direction (101) perpendicular to the pushing direction (110).

8. The device of claim 1, comprising:

at least two pushing devices (1), wherein the at least two pushing devices (1) each have a separate drive (11) which is permanently drive-connected to the corresponding slide (10).

9. The device of claim 8, wherein the at least two pushing devices (1) are arranged perpendicularly to the common pushing direction (110) and spaced apart from one another over a width of the sheet to be separated in such a way that the pushing elements (14) of the at least two pushing devices (1) jointly catch the same sheet for positive conveying, in order to separate said same sheet jointly from the stack in the pushing direction (110).

10. The device of claim 8, wherein the separate drives (11) of the at least two pushing devices (1) are connected controllably and by means of data transmission lines (61) to a control (60) of the device.

11. The device of claim 8, wherein the at least two separate drives (11) each have a linear motor, wherein in each case the stator (11.2) of the linear motor is formed from permanent magnets and in each case the controllable rotor (11.1) is arranged on the slide (10).

12. The device of claim 8, comprising a sensor system (33) for detecting the angular position of the separated sheet with respect to the pushing direction (110), wherein said sensor system is arranged downstream of the at least one retaining element (30) and connected by means of at least one data transmission line (65) to the control (60) of the device.

13. An installation for cutting sheets from cardboard and/or pasteboard, having at least a first separation device (71) for separating a sheet from a stack, having at least one transport device (72) with at least one transport direction (201) for feeding the separated sheet into:

a first cutter (73) arranged downstream of the first separation device (71) having at least one rotary cutter, said at least one rotary cutter comprising circular knives rotatable about a rotational axis for dividing the infed sheet into multiple sub-sheets, wherein the rotation axes of the circular knives forming the at least one rotary cutter are arranged essentially perpendicular to the first transport direction (201), a stacking device (74) arranged downstream of the first cutter (73) for forming an auxiliary stack from the sub-sheets, a device for separating of claim 1 arranged downstream of the stacking device (74) for separating a lowermost sheet from the auxiliary stack, wherein the pushing direction (110) of the device for separating of claim 1 runs perpendicular to the first transport direction (201), a second cutter (76) arranged downstream of the device for separating of claim 1 in the pushing direction (110), and a delivery (77) arranged downstream of the second cutter (76).

* * * * *